US008726542B2

(12) United States Patent
Kim

(10) Patent No.: US 8,726,542 B2
(45) Date of Patent: May 20, 2014

(54) SHOE HAVING A BRIDGE MECHANISM

(75) Inventor: Do Kyun Kim, Kim-Hae (KR)

(73) Assignee: LS Networks Corporation Limited (KR)

( * ) Notice: Subject to any disclaimer, the term of this patent is extended or adjusted under 35 U.S.C. 154(b) by 385 days.

(21) Appl. No.: 13/142,514

(22) PCT Filed: May 13, 2011

(86) PCT No.: PCT/KR2011/003546

§ 371 (c)(1),
(2), (4) Date: Jun. 28, 2011

(87) PCT Pub. No.: WO2011/145837

PCT Pub. Date: Nov. 24, 2011

(65) Prior Publication Data

US 2011/0302809 A1 Dec. 15, 2011

(30) Foreign Application Priority Data

May 18, 2010 (KR) ..... 20-2010-0005173 U

(51) Int. Cl.
*A43B 13/14* (2006.01)
*A43B 13/12* (2006.01)
*A43B 13/18* (2006.01)

(52) U.S. Cl.
CPC ..... *A43B 13/127* (2013.01); *A43B 13/187* (2013.01); *A43B 13/12* (2013.01)
USPC ..... 36/103; 36/30 R

(58) Field of Classification Search
CPC .... A43B 13/127; A43B 13/187; A43B 13/12; A43B 13/16; A43B 13/186
USPC ..... 36/30 R, 103, 107, 31, 25 R, 28, 35 R, 36/37, 27
See application file for complete search history.

(56) References Cited

U.S. PATENT DOCUMENTS

| | | | | |
|---|---|---|---|---|
| 6,195,915 | B1 * | 3/2001 | Russell | 36/28 |
| 6,412,196 | B1 * | 7/2002 | Gross | 36/102 |
| 7,464,489 | B2 * | 12/2008 | Ho | 36/28 |
| 7,523,566 | B2 * | 4/2009 | Young-Chul | 36/30 R |
| 7,647,709 | B2 * | 1/2010 | Reilly et al. | 36/30 R |
| 7,707,745 | B2 * | 5/2010 | Schindler et al. | 36/29 |
| 7,794,368 | B2 * | 9/2010 | Rutherford | 482/79 |
| 7,797,856 | B2 * | 9/2010 | Andrews et al. | 36/30 R |
| 7,946,059 | B2 * | 5/2011 | Borel | 36/28 |
| 2009/0320330 | A1 * | 12/2009 | Borel et al. | 36/30 R |

FOREIGN PATENT DOCUMENTS

| | | | |
|---|---|---|---|
| JP | 3120509 | U | 3/2006 |
| KR | 10-2006-0125989 | A | 12/2006 |
| KR | 10-2007-0105833 | A | 10/2007 |
| KR | 20-2011-0007477 | A | 7/2011 |
| WO | 2006/125182 | A2 | 11/2006 |

OTHER PUBLICATIONS

International Search Report mailed Jan. 18, 2012 in corresponding PCT application No. PCT/KR2011/003546.
Korean Communication, with English translation, dated Feb. 1, 2011 in corresponding Korean patent application No. KR 20-2010-0005173.
LS Networks Corp., Ltd. Brochure, with English translation, Prospecs-2010-Spring and Summer product data and specification of transaction, Feb. 11, 2010, 6 pages.

* cited by examiner

*Primary Examiner* — Jila M Mohandesi
(74) *Attorney, Agent, or Firm* — Nields, Lemack & Frame, LLC

(57) ABSTRACT

Disclosed is a shoe including a sole support, a midsole and an outsole, wherein the edge of the sole support has one or more bridges at the left and right toe area and heel, respectively.

5 Claims, 5 Drawing Sheets

SHOE HAVING A BRIDGE MECHANISM

TECHNICAL FIELD

The present invention relates to a shoe having a bridge mechanism coupled onto a midsole, which derives a straight line walking by reducing the width in left and right movement of the center of pressure during walking.

BACKGROUND ART

The present invention corresponds to the improvement of Korean Utility Model Application No. 10-00678 (hereinafter referred to as "'678 application"), entitled "A shoe having a midsole deriving a straight line walking" by the applicant of this application.

Said '678 application provides a shoe having a midsole, which derives straight line walking by dispersing the pressure of walking into the ground, improves the muscular strength of feet by forming an embedded space having a cushioning member formed of EVA having a property of absorbing the pressure of walking and an excellent elastic force, thereby stimulating the muscular strength of feet's tiptoe, and is capable of supporting the straight line walking and slide prevention by forming a buffer portion at the outsole having a good abrasion resistance.

DISCLOSURE OF INVENTION

Technical Problem

Generally, people who have a walking habit of an out-toed gait or bow-legged walk face ankle's rolling or rotation from side to side during walking due to imbalanced force application onto ankle or knee, resulting in waist or knee-associated diseases such as disc and the like. Unfortunately, the existing shoes do not have any functions to control such an out-toed gait or bow-legged walk.

Thus, the object of the present invention is to provide a shoe for preventing the user from ankle's rolling or rotation from side to side by reducing the width in left and right movement of the center of pressure during walking, which greatly improves a straight line walking inducing function.

Solution to Problem

As a result of the inventors' intensive study for preventing ankle's rolling or rotation from side to side by greatly improving a straight line walking inducing function among the functions disclosed in said '678 application to control an out-toed gait or bow-legged walking, it has been found that the said problems can be remarkably resolved by introducing a bridge structure on a midsole. The present invention has been attained on the basis of the above finding.

To accomplish the aim, in a first aspect of the present invention, there is provided a shoe comprising a sole support, a midsole and an outs ole, wherein the edge of the sole support has one or more of symmetric or asymmetric bridges on the left and right sides of tiptoe and heel, respectively.

More specifically, a shoe according to the present invention comprises an outsole (20), a midsole (6') coupled onto the outsole (20), and a sole support (30) coupled onto the midsole (6'), wherein the said outsole (20) is divided into a portion corresponding to front foot (20*a*) and a portion corresponding to behind foot (20*b*), the said midsole (6') is provided with cushioning members (1,2) at concave portions corresponding to front foot and behind foot of upper part of the midsole (6'), the said midsole (6') is provided with an elastic member (3) at a concave portion corresponding to middle foot of bottom part of the midsole (6'), the said midsole (6') is provided with two molding rubbers (4) at left and right concave portions corresponding to front foot of bottom part of the midsole (6'), the said the midsole (6') comprises grooves (7') formed on a slant at side and bottom part of the midsole (6'), which the grooves (7') receives bridges (7) formed at left and right sides of edge (6) of sole support (30), the said midsole (6') comprises protruded portions at a portion corresponding to middle foot of upper part of the midsole (6'), the said sole support (30) comprises the edge (6) which is open at tiptoe of a portions corresponding to front foot, and buffer spaces (8, 9, 10, 11) which are formed to receive the protruded portions of the midsole (6'), the said bridges (7) are integrally formed with the edge of said sole support (30), and the end portion of the said bridges (7) are formed on a slant torward the inside of shoe.

According to the present invention, the edge of the sole support may have two or more, for example four or eight bridges. For example, the edge of the sole support may have two bridges at the left of tiptoe, two bridges at the right of tiptoe, two bridges at the left of heel and two bridges at the right of heel. Further, the bridges may be formed at the arch of the foot.

If necessary, bridges may be formed at only tiptoe or heel, or only at left or right of the edge. In case of person having the walking habit of an out-toed gait, bridges at the inside of shoe may be removed. On the contrary, in case of person having the walking habit of bow-legged walk, the bridges at the outside of shoe may be removed.

According to the present invention, the bridges are connected to each other torward ground and the end portion of the bridges are perfectly coupled onto a bottom of the midsole. The shape of bridges may be formed on a slant but not limited thereto. Examples of such shape may include 八-chinese letter type, inverted 八-chinese letter type, or vertical type.

According to the present invention, the midsole of the shoe may have grooves as many number as said bridges in order to receive the bridges.

According to the present invention, in the outsole of the shoe, the portion corresponding to front foot of tiptoe is separated from the portion corresponding to behind foot of heel. Furthermore, portions corresponding to front foot and behind foot comprise pieces for sliding against the ground.

The shoe according to the present invention comprises a sole support, a midsole and an outsole and the all the parts constituting them are adhesively bonded through strong adhesives.

Advantageous Effects of Invention

The shoe according to the present invention has a bridge structure on the sole support which is coupled onto the midsole of shoe, thereby concentrating the center of pressure on the center of shoes from the inside or outside of the shoe. As a result, the width in left and right movement of the center of pressure can be remarkably reduced, which not only greatly improves a straight line walking function but also prevents user's ankle from rolling or rotation from side to side due to the imbalanced dispersion of body weight.

| * Description of marks | |
|---|---|
| 1, 2: | cushioning members |
| 3: | elastic member |
| 4: | molding rubber |
| 5: | through hole |
| 6: | edge |
| 6': | midsole |
| 7: | bridge |
| 7': | groove |
| 8, 9, 10, 11: | buffer space |
| 20: | outsole |
| 20a: | a portion corresponding to front foot |
| 20b: | a portion corresponding to behind foot |
| 30: | sole support |

BEST MODE FOR CARRYING OUT THE INVENTION

In the following, the present invention will be explained in greater detail in reference to the attached drawings.

Figure 1:
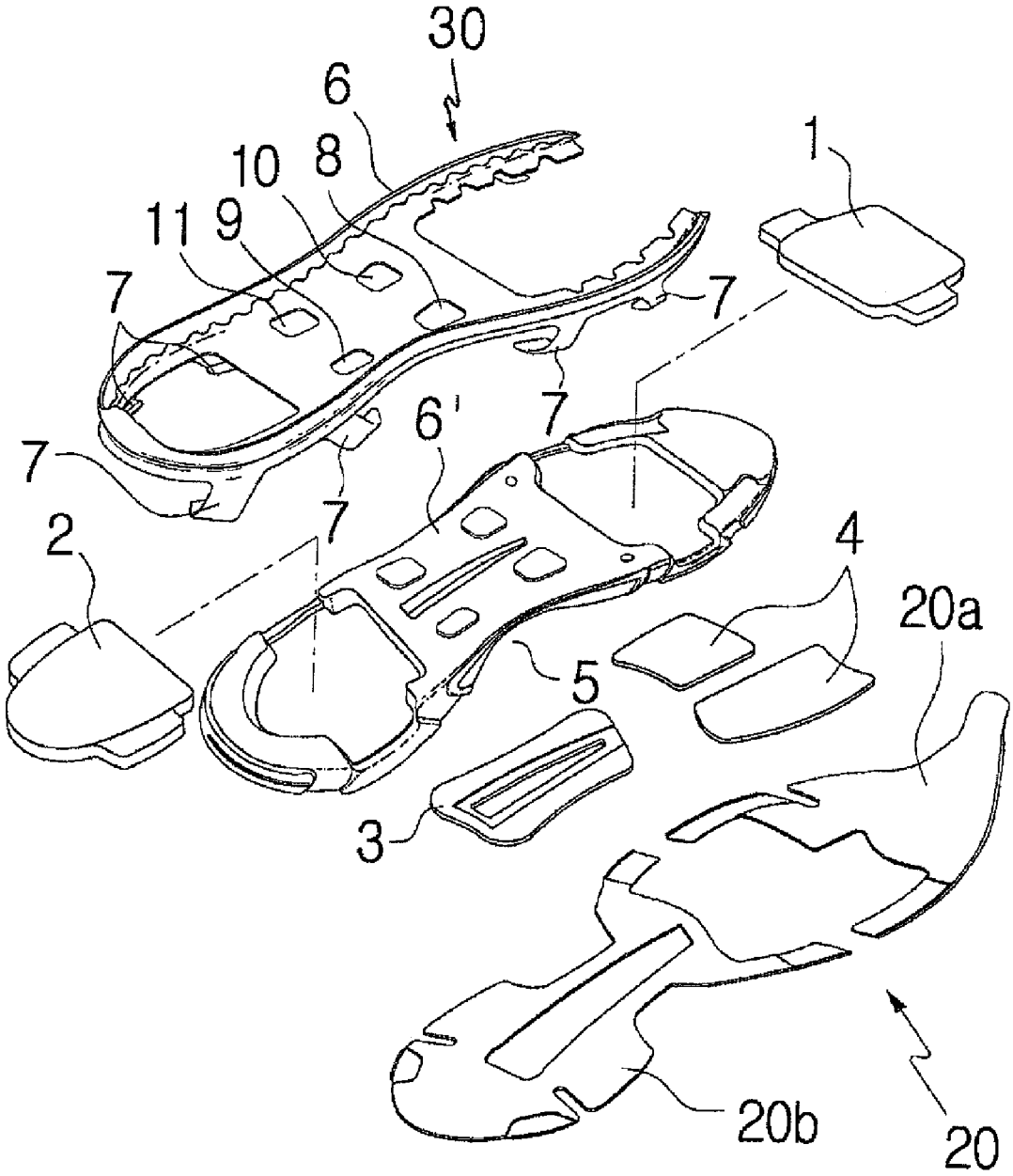
FIG. 1 shows a disintegrated perspective view of a shoe comprising a sole support (30) having bridges (7) at the edge according to the present invention, a midsole (6') and an outsole (20).

FIG. 1 shows a disintegrated perspective view of a shoe comprising a sole support (30) having bridges (7) at the edge according to the present invention, a midsole (6') and an outsole (20).

Figure 2:
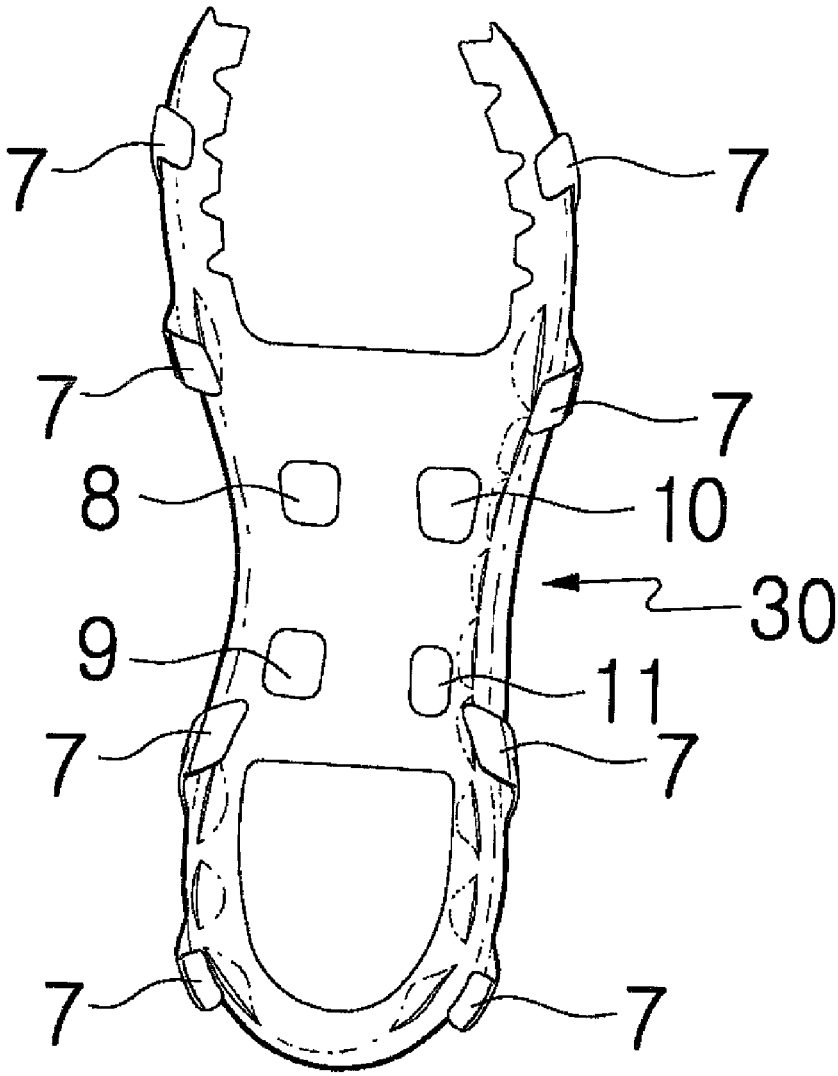
FIG. 2 shows a plan view of a sole support (30) having bridges (7) at the edge according to the present invention.

FIG. 2 shows a plan view of a sole support (30) having bridges (7) at the edge according to the present invention. The sole support (30) have for example, four buffer spaces (8, 9, 10, 11) at the center of the shoe in order to receive four protruded portions (not depicted in the drawings) at the center of midsole (6'). Further, the edges (6) at both sides of said sole support (30) may have two or more of bridges (7), respectively. The number of buffer spaces and protruded portions may be suitably increased or decreased as necessary.

According to the present invention, the edges (6) at the left and right sides of said sole support (30) may have two or more bridges (7), for examples, four or eight bridges (7). The number of bridges may be suitably changed as necessary. However, preferably, the edge of the sole support may have two bridges (7) at the left edges (6) of tiptoe, two bridges (7) at the right edges (6) of tiptoe, two bridges (7) at the left edges (6) of heel and two bridges (7) at the right edges of heel. The position of bridges (7) may be appropriately modified to be a left and right symmetrical or asymmetrical as necessary.

Depending on the use's walking habit, the edge of the sole support may have bridges (7) only at the portion of tiptoe or heel, or at the left or right side of edge. For example, in case of person having a walking habit of an out-toed gait, it is more effective to control the walking habit of an out-toed gait by removing the bridges at the inside of shoe to concentrate the center of pressure on the inner side of shoe. On the contrary, in case of person having a walking habit of a bow-legged walk, it is effective to control the walking habit of a bow-legged walk by removing the bridges at the outside of shoe to concentrate the center of pressure on the inner side of shoe.

According to the present invention, since the bridges (7) are coupled to each other torward ground and the end portion of the bridges is perfectly coupled onto the bottom of midsole (6'), the bridges (7) are stable, which can prevent user's ankle from rolling or rotation from side to side. This constitutes the object of the present invention.

According to the present invention, the midsole (6') has grooves (7') as many number as bridges (7) in order to receive the bridges (7), with the grooves having the same shape as the bridges toward the ground.

Figure 3:
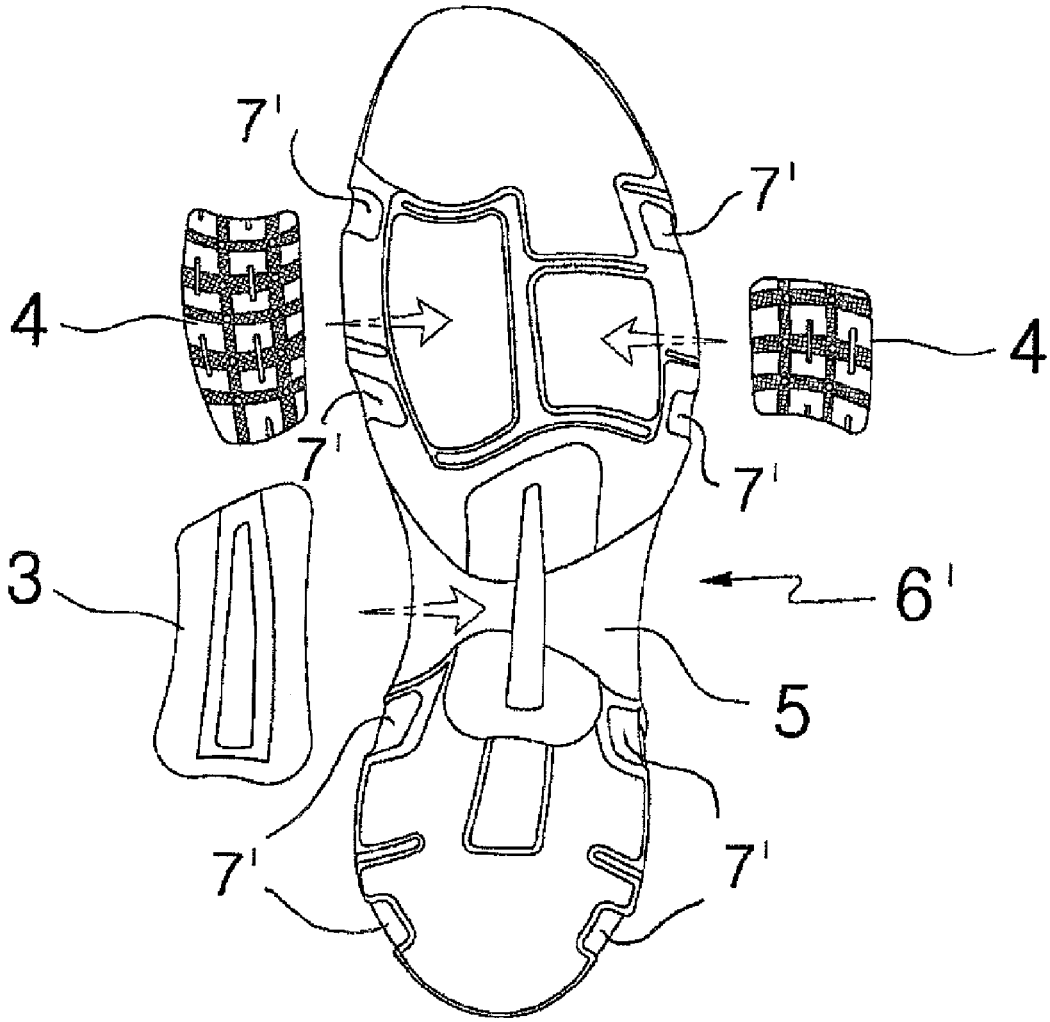
FIG. 3 shows a disintegrated view of a midsole (6') positioned between the sole support (30) and the outsole (20) according to the present invention.
Figure 4:
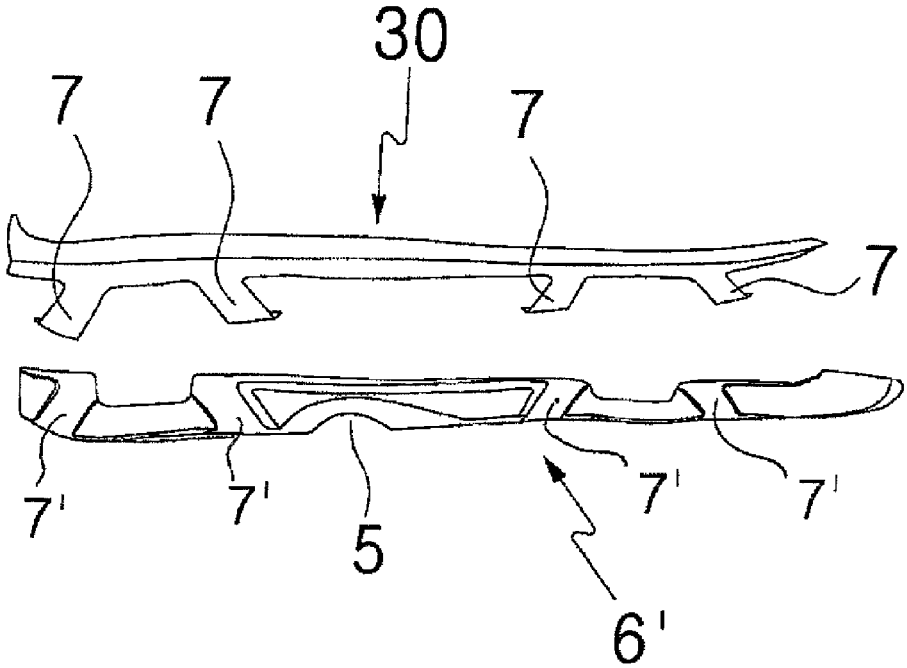
FIG. 4 shows a side view depicting the disintegrated status of the sole support (30) having bridges (7) at the edge (6) according to the present invention, and midsole (6').

The end portion of the bridges (7) is curved toward the inner side of shoe, which makes it securely coupled onto the corresponding grooves (7') of the midsole (6') (see FIGS. 3 and 4).

The buffer spaces (8, 9, 10, 11) have a role to enfold the user's foot and prevent the shoe from twisting.

The bridges (7) can play the role as a center dispersing the load of ankle to which the user's body weight is dispersed during walking into eight portions, thereby preventing the user's ankle from rolling or rotation from side to side by means of eight bridges (7) to control the walking habit of an out-toed gait or bow-legged walk, which derives a straight line walking.

FIG. 3 is a disassembly view showing a bottom part of a midsole (6'), which is located between an outsole (20) and a sole support (30) having bridges (7) at edges (6) according to the present invention. In the center part of the midsole (6'), there is an opening the shape of which has a slit type being long and narrow in its longitudinal direction and which has wedge-type having a width, a front part of which is narrower than its rear part as well. Furthermore, molding rubbers (4) are provided on the bottom part of the midsole (6'), and an arch shape elastic member (3) is provided on the wedge-type opening. A slit type opening corresponding to the wedge-type opening in the midsole (6') is formed in the elastic member (3), so that the center of pressure in a portion corresponding to middle foot upon walking is guided to the ground, thereby enabling minimization of left and right movement of foot.

The wedge-type opening alone can serve to guide the center of pressure inward to some extent, but since such structure is insufficient in effects, by providing the bridges according to the present invention, as mentioned above, the effect of concentrating the center of pressure inward can be remarkably improved.

Furthermore, a through hole (5) is formed in the center of the bottom part of the midsole (6) (see FIGS. 3-5), so that impacts from the ground upon walking is firstly absorbed, thereby not only reducing impacts transferring from a foot to a spine but also controlling twist of a shoe and smoothing bending operation of shoes during walking.

The molding rubber (4) in the bottom part of the midsole (6') is light-weighted than a normal rubber so as to enhance absorption of impacts and minimize the impacts transferred from the ground upon waling.

Such structure of the midsole (6') may concentrate the center of pressure in a portion corresponding to middle foot upon walking to the ground in cooperation with the bridges (7) coupled to the left and right edge (6) of the sole support (3) and minimize the width of left and right movement of a foot. Thus, it is efficient in controlling a walking habit of an out-toed gait and an bow-legged walk and leading to a straight line walking habit.

FIG. 4 is a side view showing a disassembled state of the midsole (6') and the sole support (30) having bridges (7) on the edge (6) according to the present invention. In this example, the bridges (7) are formed on the edge (6) of a tiptoe in the sole support (30) symmetrically in left and right directions. Likely, /\ -chinese letter type bridges (7) are formed on the edge (6) of a heel in the sole support (30) symmetrically in left and right directions.

Figure 5:
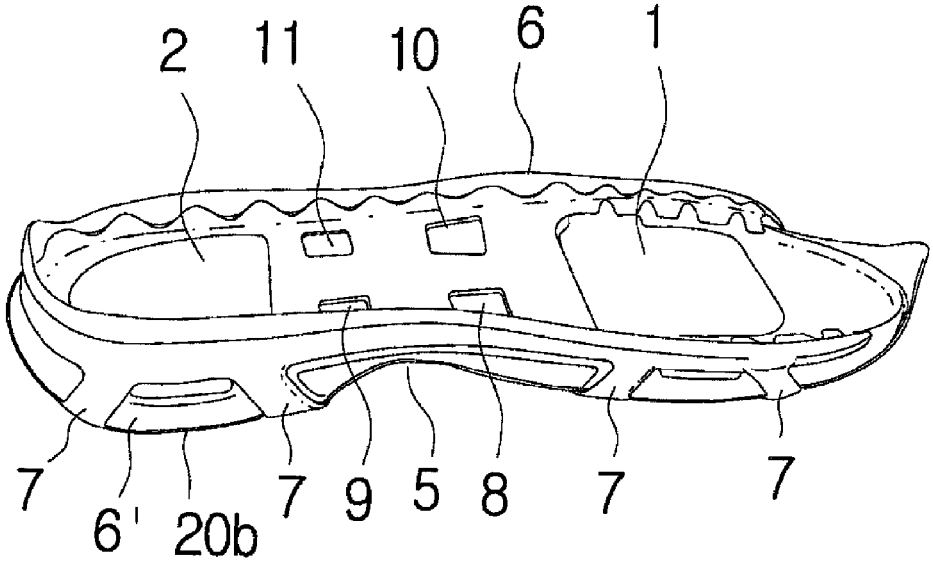
FIG. 5 shows a perspective view depicting the coupled status of the sole support (30) having bridges (7) at the edge (6) according to the present invention, and midsole (6').

FIG. 5 is a perspective view showing a state wherein the sole support (30) having bridges (7) on the edge is coupled onto the midsole (6') according to the present invention. As depicted, in this example, end portions of the bridges (7) formed on the left and right edge (6) are curved toward the inside of a shoe so that the bridges (7) are coupled with the midsole (6') through the grooves formed in midsole (6') as the bridges (7) enfold the midsole (6'). Thus, the eight bridges (7), formed in the front, behind, left and right portions, can not only evenly distribute a weight of an walker transferred to an ankle to the ground, but also guide to a strait walking habit. Also, the bridges (7) can work as a sort of fence so that a wrick due to left and right twists in a walker's ankles can be avoided.

Figure 6:
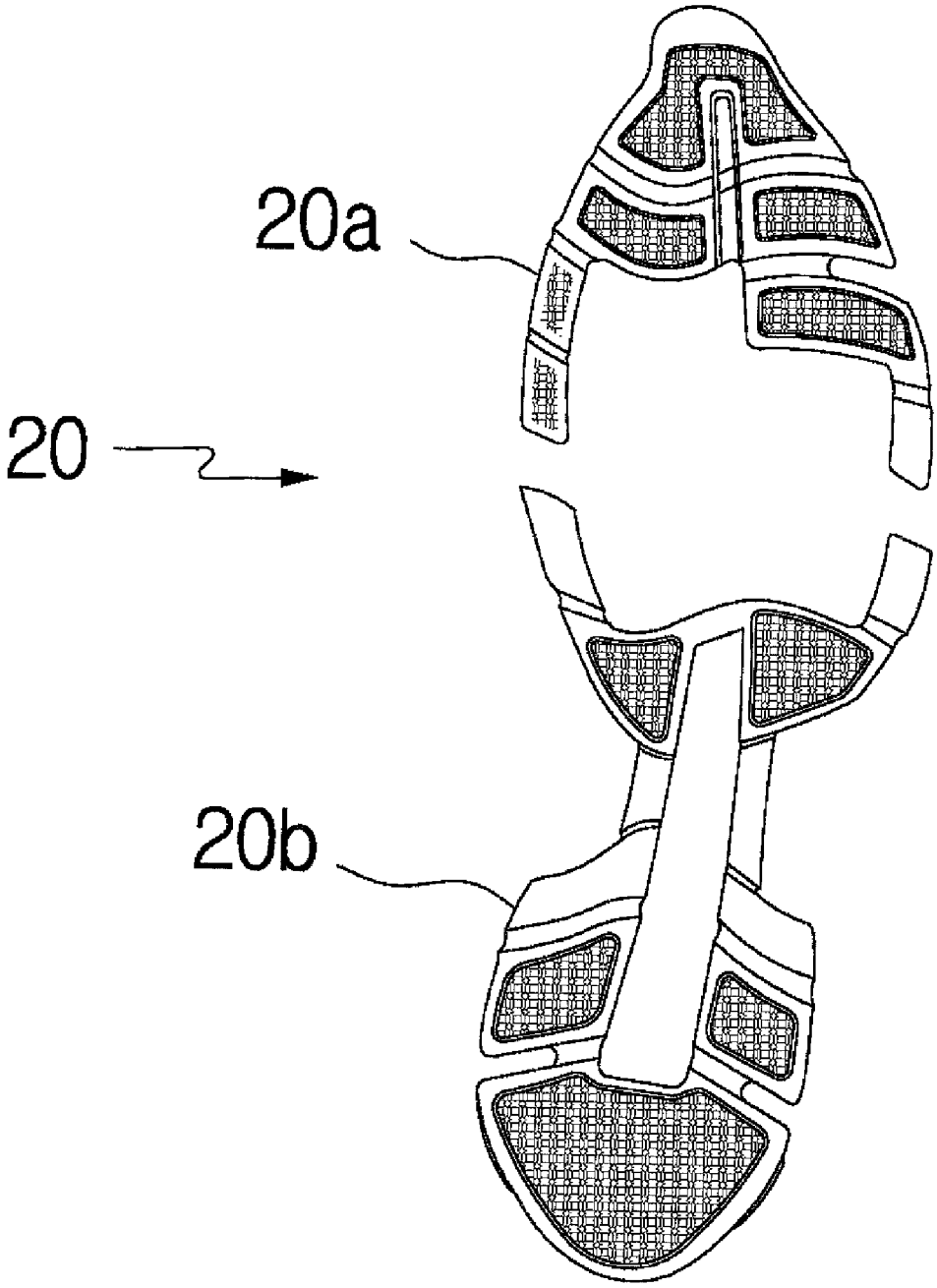
FIG. 6 shows a bottom view of the outsole (20) according to the present invention.

FIG. 6 is a bottom view showing an outsole according to the present invention. The outsole (20) according to the present invention comprises of a portion corresponding to front foot (20*a*) and a portion corresponding to behind foot (20*b*), wherein the portions corresponding to front foot (20*a*) and the behind foot (20*b*) are not formed in one piece, but separated from each other. Thus, pressure transferred to a heel is not transferred to a tiptoe, and likewise, pressure transferred to a tiptoe is not transferred to a heel, so that there is no twist in shoes and pressure transferred from ankles can be distributed to a heel and a toe separately.

It should be noted that the sole support (30) and the midsole (6'), which comprise a shoe according to the present invention, cannot solely accomplish the effects sought to be pursued in the present invention, and that only joint cooperation of them can obtain the effects of the present invention.

MODE FOR THE INVENTION

Example

In order to prove the working effects of the shoe according to the present invention, the inventor of the present invention did walk experiments as follows.

The experiments were done for 15 women and 15 men, each aged from 20 to 50, in which they wore walking shoes according to the present invention and walking shoes from companies A and B. An experiment measuring device, 'Pedar Mobile' (from NOVEL, Germany) was used and the experiments were performed according to 'Pedar M program' developed by the same company. Measuring plates in a shape of insole were selected according to the size of shoes and inserted to the shoes, and measurements were done accordingly. The measuring plate was sectioned into 100 sections, and 10,000 pressure sensors were installed in each section of the plate, and pressure to the shoes through feet was measured.

The measuring device measures center points of pressure based on pressure transferred to walker's feet from 10,000 sensors per one second, and calculates left and right change rate in center of pressure until leaving of a right leg from the right leg's touching on the ground. The lower the left and right change rate in center of pressure gets, the higher the concentration of weight pressure of feet toward the center occurs, which means it can lead to strait walking habit.

TABLE 1

| | Walking shoes of the present Invention | | Walking shoes of A company | | Walking shoes of B company | |
|---|---|---|---|---|---|---|
| Test No. | Man | Woman | Man | Woman | Man | Woman |
| 1 | 1.26 | 1.26 | 1.12 | 1.12 | 1.51 | 1.49 |
| 2 | 2.12 | 0.86 | 1.70 | 0.95 | 1.86 | 1.01 |
| 3 | 1.26 | 0.89 | 1.49 | 0.70 | 1.58 | 2.22 |
| 4 | 1.36 | 1.02 | 1.49 | 0.74 | 2.17 | 1.14 |
| 5 | 1.33 | 1.11 | 1.34 | 2.19 | 1.43 | 1.00 |
| 6 | 1.30 | 1.30 | 0.71 | 0.85 | 1.05 | 0.79 |
| 7 | 1.62 | 1.23 | 2.07 | 1.65 | 2.13 | 1.38 |
| 8 | 2.08 | 1.32 | 1.80 | 1.35 | 1.04 | 1.32 |
| 9 | 1.19 | 1.15 | 1.78 | — | 1.71 | 0.66 |
| 10 | 1.66 | 1.72 | 1.49 | 1.83 | 2.00 | 1.72 |
| 11 | 1.14 | 2.17 | 1.30 | 2.29 | 1.46 | 1.67 |
| 12 | 1.63 | 1.71 | 1.77 | 1.74 | 2.50 | 2.13 |
| 13 | 1.51 | 1.24 | 1.57 | 1.59 | 1.83 | 1.07 |
| 14 | 1.64 | 1.37 | 2.22 | 1.24 | 1.33 | 1.95 |
| 15 | 1.02 | 1.19 | 1.38 | 1.31 | 1.45 | 1.06 |
| Average | 1.474 | 1.303 | 1.549 | 1.396 | 1.670 | 1.374 |
| Total average | 1.388 | | 1.473 | | 1.522 | |

As a result of the experiments, as shown on the table above, whereas the left and right change rates in average for the shoes according to the present invention were 1.474 for the men, those for the shoes of companies A and B were 1.549 and 1.670, respectively. Meanwhile, concerning the women, whereas the left and right change rates in average for the shoes according to the present invention were 1.303, those of the shoes for the companies A and B were 1.396 and 1.374, respectively.

Also, whereas the average change rates in total for the walking shoes according to the present invention were 1.388, those for the walking shoes of the companies A and B were 1.473 and 1.522, respectively, and thus it is lower by about 0.085 and about 0.134 for the case of present invention than the companies A and B. Such differences mean that the effects of concentrating toward the center weight of feet are remarkable, therefore it is proved that the shoes according to the present invention is much more efficient in leading to a strait walking habit than the conventional shoes.

The invention claimed is:

1. A shoe comprising an outsole, a midsole coupled onto the outsole, and a sole support coupled onto the midsole, said midsole having an upper part, a bottom part and sides, wherein said outsole, said midsole and said sole support each have a front foot portion, a middle foot portion and a rear foot portion, said sole support having a heel, a toe region at said front foot portion, and an edge, said midsole having cushioning members at concave portions corresponding to said front foot portion and rear foot portion of said upper part of said midsole, said midsole having an elastic member at a concave portion corresponding to said middle foot portion of said bottom part of said midsole, said midsole having two molding rubbers at left and right concave portions corresponding to said front foot portion of said bottom part of said midsole, said midsole comprises grooves formed at said sides and bottom part of said midsole, which grooves receive bridges formed at said edge of said sole support, said midsole comprises protruded portions at said middle foot portion of said upper part of said midsole, said sole support being open at said toe region, and having buffer spaces which are formed to receive the protruded portions of the midsole, said bridges being integrally formed with said edge of said sole support, said bridges having end portions that are slanted toward the inside of the shoe.

2. The shoe according to claim 1, wherein said sole support has two bridges at the left of said toe region, two bridges at the right of said toe region, two bridges at the left of said heel and two bridges at the right of said heel.

3. The shoe according to claim 1 or 2, wherein said bridges are formed at said edge symmetrically or asymmetrically.

4. The shoe according to claim 1, wherein said sole support has two bridges at only the left and right sides, respectively, of said toe region, or two bridges at only the left and right sides, respectively, of said heel.

5. The shoe according to claim 1, wherein said bridges are formed at only the inside of said edge of said sole support, or only at the outside of said edge of said sole support.

* * * * *